US005297315A

United States Patent [19]

Yulkowski

[11] Patent Number: 5,297,315

[45] Date of Patent: Mar. 29, 1994

[54] SUSPENSION FOR HINGED DOOR

[76] Inventor: Leon Yulkowski, 40 W. Howard, Pontiac, Mich. 48058

[21] Appl. No.: 854,010

[22] Filed: Mar. 19, 1992

[51] Int. Cl.[5] ..... E05D 7/04

[52] U.S. Cl. ..... 16/248; 16/249; 16/259; 16/310

[58] Field of Search ..... 16/248, 249, 259, 262, 16/263, 270, 309, 310

[56] References Cited

U.S. PATENT DOCUMENTS 945,820 1/1910 Stuart ..... 16/310
984,724 2/1911 Wheelock et al. ..... 16/310
1,034,660 8/1912 Stuart ..... 16/310
3,973,289 8/1976 Yulkowski ..... 16/178

FOREIGN PATENT DOCUMENTS 89350 10/1958 Netherlands ..... 16/310
11944 of 1896 United Kingdom ..... 16/310

*Primary Examiner*—W. Donald Bray

[57] ABSTRACT

The suspension of a door hinged within a frame for swinging movements in a horizontal plane includes an elongated metal cable with blocks secured upon its ends, with spaced apertures within the frame and door and with blocks projected into said apertures and supportably interlocked with the frame and door.

15 Claims, 2 Drawing Sheets

SUSPENSION FOR HINGED DOOR

FIELD OF THE INVENTION

Relates to doors hinged within a frame or aperture in a wall for swinging in a horizontal plane together with a separate suspension of the door upon the frame or wall against vertical movements of the door relative to the frame.

BACKGROUND OF THE INVENTION

Often when hinging a door within the opening of a frame or wall there is no room for vertical adjustments of the door with respect to the frame. In such situations it has been known to provide a continuous hinge for mounting the door within the frame in order to define its pivotal or swinging movements relative to the frame in a horizontal plane. Under this circumstance it is necessary to provide a separate suspension for the weight of the door within the frame such as a rigid bar with hook ends, with one hooked end secured upon a portion of the door frame and with the other hooked end underlying and supporting the door or connected therewith immediate its top and bottom.

THE PRIOR ART

In applicant's U.S. Pat. No. 3,973,289 entitled "Door Hinge" there is disclosed such a hinge and wherein there is further disclosed the use of a support hangar strap which extends along the height of the door with its upper end reversed turned over the top of the door frame and with its lower end reversed turned over the under surface of and supportably engaging the door or an intermediate portion thereof.

Such metal hangar rod, effective in many situations was subject to abuse during use or assembly such as would bring about failure of the door assembly which was seen as a product failure instead of abuse.

In order to make the hook strong enough the metal had to be hardened to such a degree that the yield and ultimate strength were very close. Fracture would result in a brittle looking fracture.

Abuse during installation of the door and with the use of a rigid hangar rod often created stress cracking after installation. This would not be apparent for weeks or months, when failure of the hinge assembly would occur.

Previously in the use of the metal support rod, any opening movement of the door created a torque which tended to close the door automatically when it was desired that the door be left open.

In previous use of the rigid metal support rod suitable fastening devices were required for interconnecting the hooks at its opposite ends with the frame and with portions of the door.

SUMMARY OF THE INVENTION

The present invention represents an improvement in the metal hangar rod disclosed in applicant's U.S. Pat. No. 3,973,289.

An important feature of the present invention is the use of a flexible metallic cable wherein anchor blocks are secured over and adjacent opposite end portions of the cable and wherein said blocks are nested within corresponding apertures within the frame for suspension and within the door or part of the hinge housing secured to the door for suspending the door against vertical movements relative to the frame.

Another feature is to provide a length of cable having attached thereto elongated metal blocks and with the blocks designed to have a unique interlocking relationship with apertures within the door and frame.

It is another feature to incorporate the use of a cable with such sufficient strength that a load failure point can be controlled as a multiple of the door weight such as five times even in doors whose weight runs between 100 and 600 pounds.

Another important feature includes in the case of a failure the inexpensive cable is easily replaced rather than tearing out the hinge housing assembly or the door aperture.

Another feature in the use of a cable is that it prevents the build up of a resisting torque during opening which tends to close doors which were desired to be left open.

A further feature is the use of the present suspension cable and mount blocks and their interlock with apertures within the frame and door which requires no fastening devices.

As another feature a rigid rod may replace the cable.

These and other features and objects will be seen from the following specification and claims in conjunction with the appended drawing.

THE DRAWINGS

Figure 1:
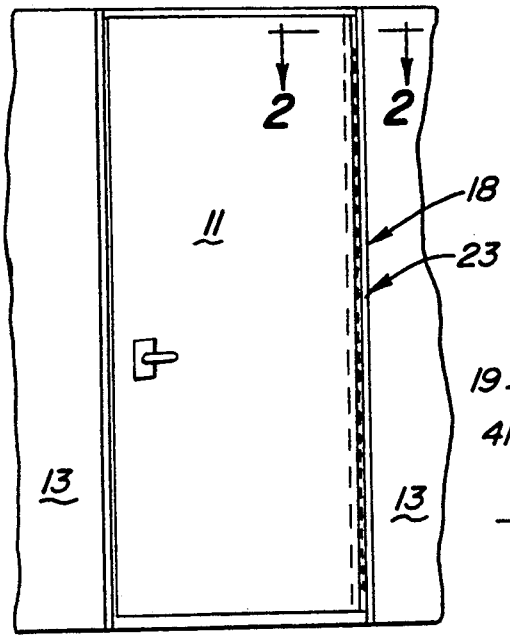
FIG. 1 is a fragmentary front elevational view of a frame or wall with a door hinged and suspended therein.
Figure 3:
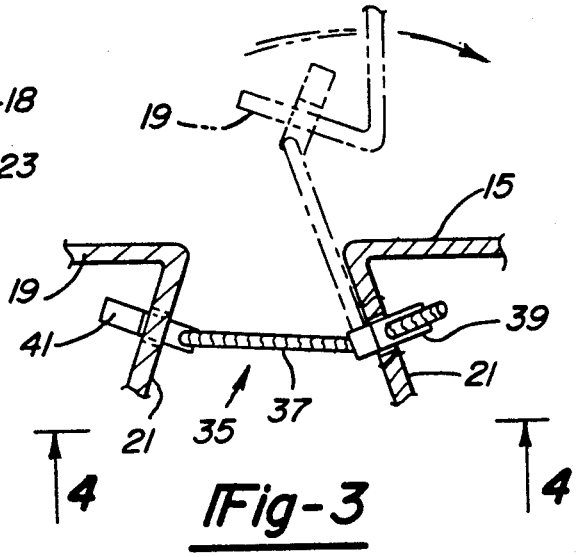
FIG. 3 is a plan section of the assembly of the cable and blocks with respect to hinge housings in accordance with the circle diagram as a part of FIG. 2, and on an increase scale.

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

Referring to the drawings FIGS. 1–6, door 11, constructed of wood, metal or glass and having sometimes an anodized aluminum coating or a wood veneer is nested within frame 13 or within a corresponding aperture of a wall.

Figure 2:
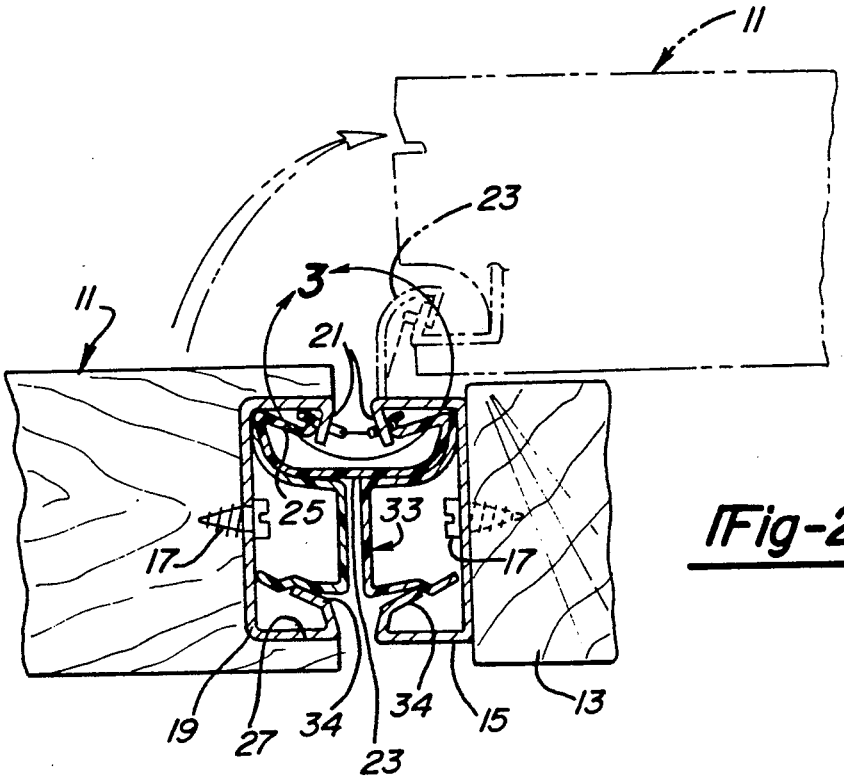
FIG. 2 is a fragmentary section taken in the direction of arrows 2—2 of FIG. 1, and on an increased scale.
Figure 4:
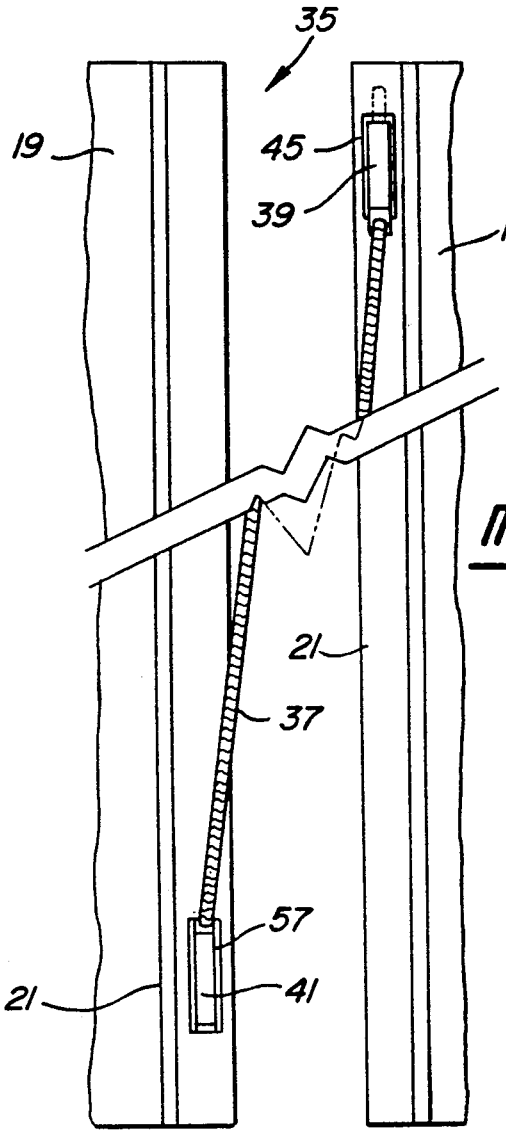
FIG. 4 is a fragmentary front elevational view of the suspension cable and its connections to the door frame and door.

An elongated hinge housing 15 of generally U-shape is mounted along one upright edge of frame 13 and secured thereto by a plurality of spaced fasteners 17, FIG. 2.

A hinge assembly as generally indicated at 18, FIG. 1, by which the door is rotatably mounted within and upon frame 13 for movements only in a horizontal plane. In the illustrated embodiment the hinge assembly 18 extends substantially between the top and bottom of the door.

Opposed and spaced from hinge housing 15 is a second hinge housing 19 for door 11. Along the hinge housings and substantially throughout their length are the reversed turned generally upright hinge anchor flanges 21.

Hinge housing 19 is mounted upon, within and along one edge of door 11, is generally U-shaped, and extends substantially throughout the height of the door. In the illustrative embodiment, said housing includes a reverse turned hinge anchor flange 21 symmetrical to hinge housing 15 and its anchor flange 21.

Hinge housing 19 is nested within the elongated door channel 27 which extends substantially the height of door 11. Hinge housing 19 is nested within door channel 27 extending along the upright edge of door 11. It is secured thereto by a plurality of longitudinally spaced fasteners 17, FIG. 2.

An elongated generally U-shaped hinge 23 extends substantially the height of the door and throughout the height of the respective hinge housings. Said hinge includes a pair of opposed inturned ends 25, FIG. 2 which nest within the corresponding hinge anchor flanges 21 forming a part of the respective hinge housings 15 and 19.

Elongated continuous hinge 23 provides an effective, efficient hinge connection between the door 11 and the frame 13 substantially throughout its height. This hinge construction is shown in Applicant's U.S. Pat. No. 3,973,289 dated Aug. 10, 1976. The detailed construction of said hinge assembly is incorporated herein by reference.

The foregoing hinge and its assembly, such as is disclosed in said patent and herein, provides a means for hingedly interconnecting door 11 within frame or wall 13, so that it is capable of swinging movements with respect to the frame in horizontal planes. Each of the respective hinge housings 15 and 19 include along their opposite longitudinal edges the corresponding reversed turned stop flanges 34, FIG. 2.

This provides a means for the insertion and interlock between the respective hinge housings of hinge block 33. It is inserted to retainingly engage portions of hinge 23 relative to flanges 21. Said block anchors hinge 23 and is yieldably retained in housings 15 and 19 by the opposed stop flanges 34 forming a part of the respective hinge housings 15 and 19. This construction is further disclosed in Applicant's U.S. Pat. No. 3,973,289.

DOOR SUSPENSION

Figure 5:
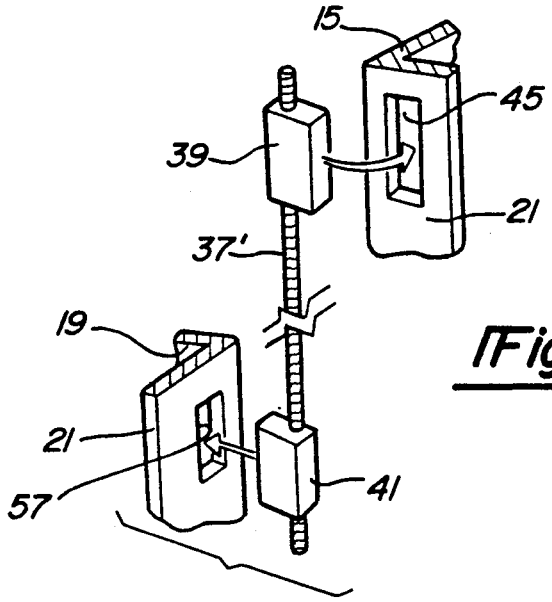
FIG. 5 is a fragmentary exploded and perspective view of the present cable assembly illustrating insertion of anchor blocks within corresponding apertures in the hinge housings for the door and frame.

Suspension for the weight of the door and its mounting upon and suspension upon frame 13 is generally indicated at 35, FIGS. 3–6. The suspension herein defined represents an improvement over the unit metal hangar rod assembly 69, 71 and 73 disclosed in Applicant's U.S. Pat. No. 3,973,289. Instead of the rigid bar or hangar bracket 69 with reversed turned ends 71 and 73 shown in such patent, applicant provides an elongated flexible metallic cable 37 or rod 37' as shown in FIG. 5. Said cable has a diameter within the range of 5/64 inches to ⅛ inch. It is preferably made of steel. It has a tensile strength of 250,000 pounds per square inch. In final assembly it may have a yield up to 1/64".

On or adjacent one end of cable or rod 37 is secured by swagging or coining the rectangular metal anchor block 39, immovably secured thereto. A bottom anchor block 41 of the same construction is mounted over another end portion of cable or rod 37 and suitably secured thereto as by swagging or coining or the like.

Figure 6:
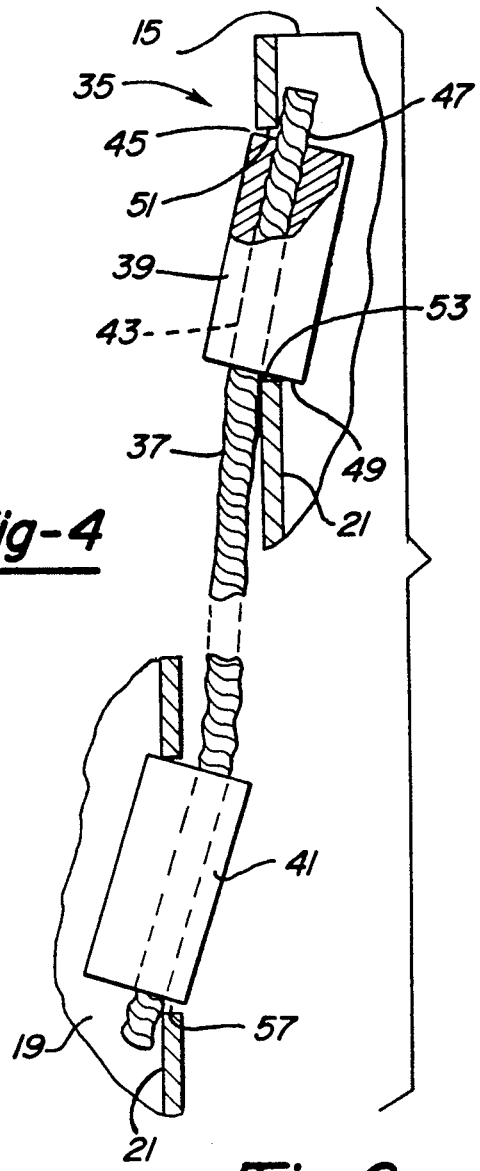
FIG. 6 is a longitudinal cross sectional view corresponding to FIG. 4, with a portion of one block cut away and sectioned and the blocks assembled within adjacent apertures within the hinge housings for the door and frame.

In the illustrative embodiment, said blocks have a longitudinal bore 43 which is laterally offset from the center line of the block, FIG. 6. The respective blocks are assembled over the corresponding ends of cable or rod 37 and effectively secured thereto as by swagging. The block before swagging is approximately 0.250 inches wide and after swagging 0.300 inches.

Said block before swagging has a thickness of 0.156 inches. After swagging the thickness has been reduced to 0.125 inches plus, or minus 0.003", for illustration.

Before swagging bore 43 is circular in cross-section, having a diameter of 0.093 inches, for illustration. After swagging the bore and the corresponding shape of the cable within the block is oval in shape.

The length of the block merely for illustrative purposes is 0.675 inches. In illustrative embodiment the spacing between blocks 39 and 41 is 23.250 inches. It is contemplated that this spacing could differ depending upon factors including the height of the door to be hinged within said frame.

Formed within hinge anchor flange 21 of hinge housing 15 is an elongated generally upright rectangular slot 45 with a length and width which exceeds the dimensions of anchor block 39 so as to cooperatively receive said block, FIG. 6. With block 39 assembled within aperture 45 and block 41 assembled within aperture 57, the respective blocks are anchored against lateral in and out movements and against movements up and down with respect to the corresponding hinge housings 15 and 19.

Anchor point 47, FIG. 6, prevents lateral outward movement of block 39 and adjacent cable end portion with respect to hinge housing 15. Anchor point 49 prevents lateral movement of block 39 in the opposite direction.

Anchor point 51 limits relative upward movement of the block, and anchor point 53 prevents relative downward movement of the block with respect to hinge housing 15 and the corresponding aperture 45.

Such interlock of the respective blocks 39 and 41 with respect to the corresponding hinge housings 15, 19 require no fasteners and are self-locking once completed and with the cable under suspension of the weight of the door.

By this construction there is established a unique interlocking relationship between door 11 and the frame 13 such that:

(a) The cable 37 has a predictable load carrying capacity, because all stresses are in pure tension or shear.

(b) The cable 37 will fail only at a controllable load.

(c) Such load failure point can be controlled within plus/minus 3%.

(d) Such load failure point can be controlled as a multiple of the door weight, such as five times, for illustration.

(e) Ultimate failure of the hinge assembly will be seen as overload and not product failure.

(f) Failure would always occur in the easily replaced and inexpensive cable 37, rather than tearing out the hinge housings or the apertured door body.

Another advantage of this construction is that abuse during installation would be virtually impossible because of the flexibility of the cable itself. The rigid hangar rod disclosed in Applicant's U.S. Pat. No. 3,973,289 could have a stress crack created during installation which would not be apparent for weeks or months when failure would occur.

Another advantage is that the cable does not build up a resisting torque during door opening. This tended to close doors which were desired to be left open.

In accordance with the present disclosure, the length of cable 37, swagged attachments or blocks 39, 41 their shapes are interlocked with correspondingly shaped openings within the hinged housings on the door frame and door.

As an alternative construction, cable 37 is replaced by a rigid metallic rod. The corresponding anchor means, or metal anchor blocks 39 and 41 are assembled over end portions of said rod and swagged or otherwise fixed thereon.

Top block 39 is inserted into and retainingly nested within hinge housing aperture 45. Lower block 41 is inserted into and retainingly nested within door hinge housing aperture 57.

In addition to supporting door 11, said rod may be prestressed before mounting to allow the rod suspension to act as a spring hinge, normally by biasing the door to open or closed position.

In operation flexible cable 37 can be twisted before insertion of the blocks, or one of them, for shortening the cable length. This provides the means for raising or lowering the door relative to the frame.

Having described my invention reference should now be had to the following claims.

I claim:

1. In combination, an apertured door frame;

a door nested within said frame;

an elongated hinge assembly interconnecting one upright door edge with a corresponding edge of said frame for swinging movements of said door in a horizontal plane; and a flexible cable adjacent one end supportably anchored to and suspended from an upper portion of said frame, extending along said hinge and at its other end supportably connected to and suspending said door within said frame against downward movements relative to said frame.

2. In the combination defined in claim 1, further comprising spaced anchor means secured upon the ends of said cable, nested within and interlocked with said frame and door respectively.

3. In the combination of claim 2, further comprising said interlock including apertures within said frame and door with said anchor means nested within said apertures respectively.

4. In combination of claim 2, further comprising said flexible cable being adapted to be twisted before insertion of said anchor means providing for shortening the cable length for raising or lowering the door relative to said frame.

5. In the combination defined in claim 3, further comprising said apertures being of rectangular shape and said anchor means being metal blocks receiving and secured over end portions of said cable.

6. In combination an apertured door frame;

a door nested within said frame;

opposed upright continuous hinge housings of channel shape secured along their length to corresponding door and frame edges;

an elongated hinge assembly extending along the length of said hinge housings and flexibly interconnecting said hinge housings for swinging movements of said door in a horizontal plane;

an elongated flexible metallic cable adjacent one end supportably anchored and suspended from an upper portion of one hinge housing, extending along said housings and at its other end supportably connected to the other hinge housing to supportably connect and suspend said door within said frame against relative downward movements.

7. In the combination of claim 6, further comprising spaced anchor means secured upon the ends of said cable nested within and interlocked with said hinge housings respectively.

8. In the combination of claim 7, further comprising said interlock including apertures within said housings, with said anchor means nested within said apertures respectively.

9. In the combination defined in claim 8, further comprising said apertures being of rectangular shape and said anchor means being metal blocks of similar shape receiving and secured over end portions of said cable.

10. In the combination defined in claim 9, further comprising said blocks having a longitudinal bore, said end portions of said cable extending through said bores respectively;

said blocks being swaged over and compressively and retainingly engaging said cable ends and anchored thereon.

11. In the combination of claim 10, further comprising said bore being laterally offset.

12. In the combination defined in claim 9, further comprising said apertures being of limited oversize relative to said blocks, for cooperatively receiving said blocks and end portions of said cable respectively;

said blocks and cable being interlocked with portions of said housings against movements laterally and longitudinally when said cable is in tension supporting said door.

13. In the combination defined in claim 6, further comprising said cable suspension including opposed reversed turned hinge anchor flanges extending along said hinge housings;

there being a rectangular aperture within the anchor flange of one hinge housing adjacent its upper end;

and a corresponding rectangular aperture within the anchor flange of the other hinge housing intermediate its ends;

metal anchor blocks secured over end portions of said cable and projected into said apertures respectively;

and with said cable in tension said blocks being interlocked with said anchor flanges respectively against displacement up, down and laterally.

14. In combination, an apertured door frame;

a door nested within said frame;

an elongated hinge assembly interconnecting one upright door edge with a corresponding edge of said frame for swinging movements of said door in a horizontal plane; and a rigid metallic rod adjacent one end supportably anchored to and suspended from an upper portion of said frame, extending along said hinge and at its other end supportably connected to and suspending said door within said frame against downward movements relative to said frame, the suspension of said rod and door including an aperture in said frame adjacent its top, and an aperture in said door intermediate its top and bottom, and metal anchor blocks secured over end portions of said rod, nested and retained within said apertures, respectively.

15. In the combination of claim 14, further comprising said rod being prestressed before mounting to allow the vertical rod suspension to act as a spring hinge.

* * * * *